United States Patent [19]

Wahman

[11] 4,050,211

[45] Sept. 27, 1977

[54] COUPLING DEVICE FOR JOINING TOGETHER REINFORCED CONCRETE ELEMENTS, SUCH AS CONCRETE PILES OR PILLARS

[76] Inventor: Lorentz Wahman, Viktoriagatan 32, Goteborg, Sweden, 411 25

[21] Appl. No.: 637,193

[22] Filed: Dec. 3, 1975

[30] Foreign Application Priority Data

Dec. 12, 1974 Sweden ..... 7415568
June 13, 1975 Sweden ..... 7506781

[51] Int. Cl.[2] ..... E04C 3/30; E02D 35/00

[52] U.S. Cl. ..... 52/726; 52/127; 403/294

[58] Field of Search ..... 52/726, 731, 733, 127; 403/294, 408, 292

[56] References Cited

U.S. PATENT DOCUMENTS

| | | | |
|---|---|---|---|
| 2,353,444 | 7/1944 | Conradty et al. | 403/294 |
| 3,248,888 | 5/1966 | Williams | 52/726 |
| 3,504,500 | 4/1970 | Fristedt | 52/726 |
| 3,650,553 | 3/1972 | Wennstrom | 403/294 |
| 3,838,547 | 10/1974 | Meisberger | 52/726 |

FOREIGN PATENT DOCUMENTS

| | | | |
|---|---|---|---|
| 1,171,222 | 1/1959 | France | 403/294 |
| 1,363,998 | 8/1974 | United Kingdom | 52/726 |

*Primary Examiner*—Price C. Faw, Jr.
*Assistant Examiner*—Robert C. Farber
*Attorney, Agent, or Firm*—Holman & Stern

[57] ABSTRACT

There is provided a coupling device for joining together reinforced concrete elements, such as concrete piles or pillars. The device comprises a plurality of first coupling means for locked arrangement on the mutually opposing faces of two segments to be joined together. Each of said first coupling means has means for receiving a second coupling means so that the first coupling means of the two opposing faces are held in mutually locked relationship by said second coupling means.

12 Claims, 11 Drawing Figures

28
26
26
22
1
23
17
18
13
IX
2
29
18
26
26
IX
26
27
26

COUPLING DEVICE FOR JOINING TOGETHER REINFORCED CONCRETE ELEMENTS, SUCH AS CONCRETE PILES OR PILLARS

The present invention relates to a concrete-segment coupling device, for joining together reinforced concrete sections such as reinforced concrete pile or pillar segments and being of the type in which the longitudinally extending reinforcing rods of a pile or pillar segment are connected to the coupling device and in which a connecting means for connection with the coupling device of a further pile or pillar segment is arranged substantially opposite said longitudinally extending reinforcing rods.

It is previously known to provide such coupling devices in the form of a casing provided with connecting elements of the longitudinal reinforcing rods of a pile or pillar segment and with connecting means for joining said segment to a further segment. The coupling device, which comprises a unit made, for example of nodular iron, is heavy and therewith diffcult to handle whilst, at the same time, the cost of material and manufacture is high.

Since differenct piles and pillars have different cross-sectional dimensions and cross-sectional shapes, it is necessary to manufacture and to store pile segments and pillar segments of many different types and dimensions, which creates serious storage problems and therewith high costs. An object of the present invention is to provide a coupling device which satisfies extremely close tolerances and which can thereby be used both for piles and for pillars and the like, and which device is of simple manufacture and assembly and which is less expensive to manufacture than previously known coupling devices and which can be used irrespective of the cross-sectional shape and dimensions of the concrete segments. The coupling device device shall be so designed that it can be used with simple auxiliarly devices as a support for transverse beams, plates or the like.

Accordingly there is provided a concrete-segment coupling device for joining together reinforced concrete segments having reinforcing rods extending therethrough, said device comprising a plurality of pairs of first coupling means adapted to be secured to opposing faces of two concrete segments to be coupled together in register, and a plurality of second coupling means received in said first coupling means for coupling together said pairs of first coupling means.

The invention will now be described in more detail with reference to embodiments thereof shown in the accompanying drawings, in which.

Figure 1:
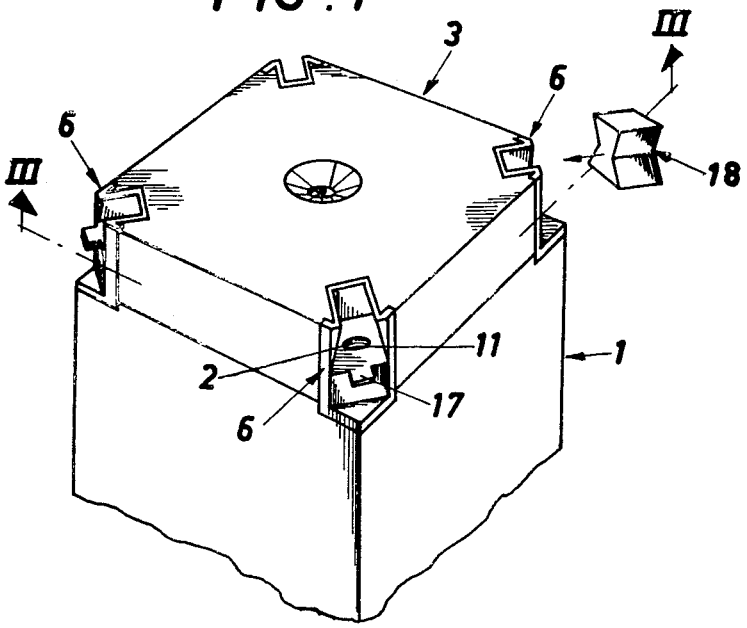
FIG. 1 is a perspective view of one end of a pile or pillar segment provided with a coupling device according to the invention.
Figure 2:
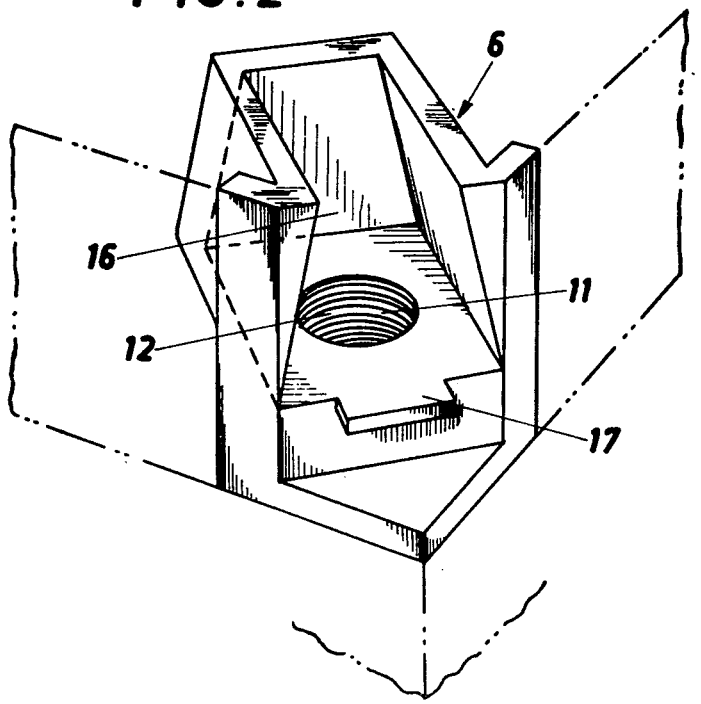
FIG. 2 shows in larger scale a perspective view of a connecting means.
Figure 3:
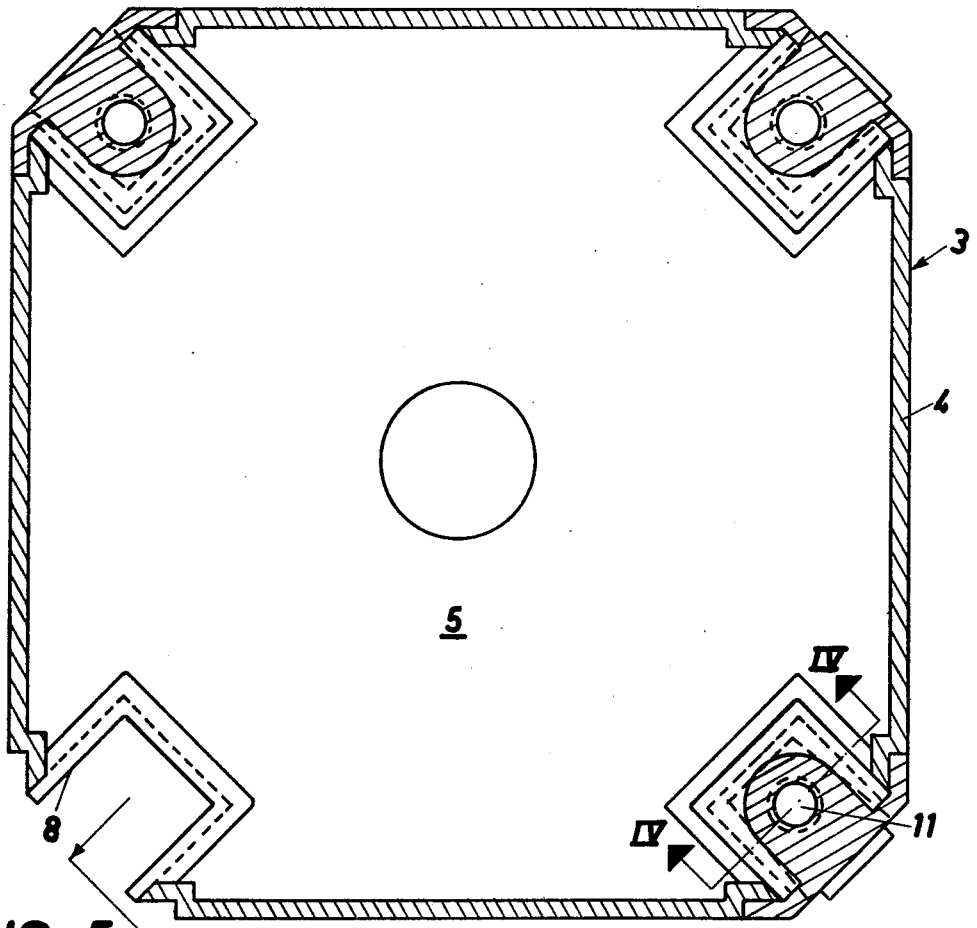
FIG. 3 is an enlarged sectional view taken along the lne III—III of FIG. 1.
Figure 5:
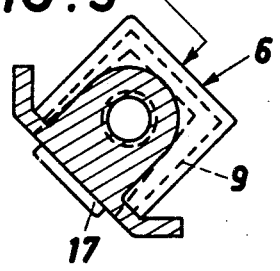
FIG. 5 is a section through the line V—V in FIG. 4.
Figure 4:
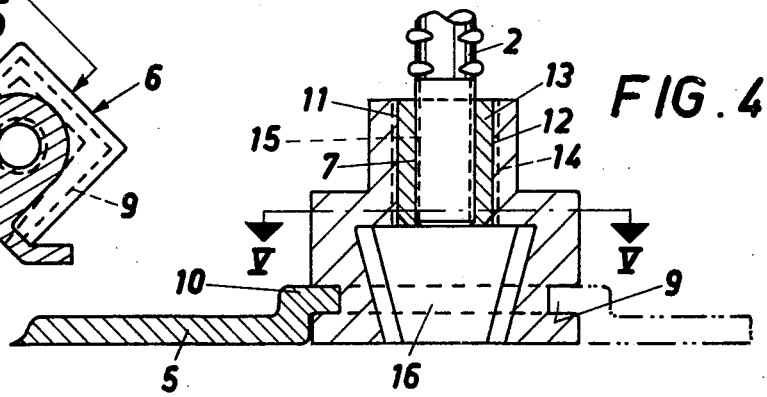
FIG. 4 is a section through the line IV—IV in FIG. 3.

In FIGS. 1 to 5 there is shown a reinforced concrete pile or pillar segment 1 provided with longitudinally extending reinforcing rods 2 which are connected to a coupling device 3 which is adapted to be connected to a corresponding coupling device associated with a further pile or pillar segment (not shown). The coupling device 3 has substantially the same shape as the cross-sectional shape of the segment 1 and, in the illustrated embodiment, comprises a casing in which a number of connecting means 6 are arranged, said number corresponding to the number of reinforcing rods 2. The outer end of each reinforcing rod 2 is provided with a screw thread 7 (FIF. 4). The corners of the casing, which comprises a frame 4 and a bottom plate 5, are provided with recesses 8 which are intended to accommodate the aforementioned connecting means 6. The connecting means 6 are provided with grooves 9 in which a flange 10 formed on the bottom plate 5 is intended to engage. The connecting means 6 are also provided with bores 11 having internal screw threads 12, which bores 11 are intended to receive the screw-threaded ends of the reinforcing rods 2. The diameter of said ends, however, is smaller than the diameter of the bores 11 and screwed in the space between the defining walls of the bores 11 and respective rods 2 is a connecting element 13 which has the form of a sleeve having external threads 14 corresponding to the inner threads 12 of the bores 11 and inner threads 15 corresponding to the outer threads 7 of the reinforcing rods 2. One end of the connecting element 13 is so formed as to enable said element to be turned by means of a suitable tool and screwed into the threads 12 of the bore 11.

In the illustrated embodiment, the bore 11 in each connecting means 6 is arranged in the bottom of a groove 16 which, in cross-section, has a dove-tail configuration. These grooves are arranged diagonally opposite each other in each means 6 in the corners of the coupling device. Each groove 16 is intended to receive a key 18 (FIG. 1) and at the outer end of each groove 16, the groove bottom is provided with an outwardly projecting lip 17 which, subsequent to insertion of the key, is deformed, i.e. folded over, so as to lock the key 18 in position. When seen in cross-section, the key 18 has the form of a double dove-tail and is intended to connect together two pile or pillar segments placed end-to-end, each of said segments having its respective coupling device.

Each connecting means 6 is conveniently manufactured of a force-absorbing material, for example nodular iron, while the frame and the bottom plate may be manufactured from a thin and/or light material, such as a plastics material or sheet metal. In this way there is obtained a coupling device which is much lighter to handle and which can be manufactured more readily and less expensively than a coupling device which is made wholly of nodular iron. Instead of connecting the reinforcing rods 2 to the connecting means 6 via connecting elements 13, it is possible to connect said rods directly to the connecting means. In this instance the internal threads of the bores 11 correspond to the outer threads of the reinforcing rods.

Figure 10:
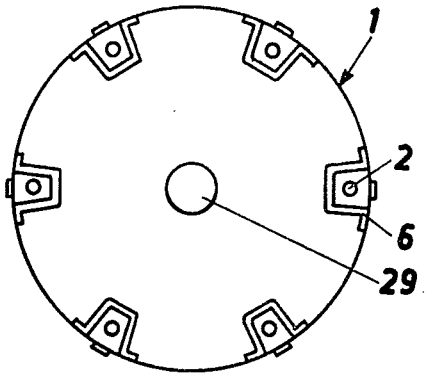
FIGS. 10 and 11 are end views of coupling devices for pile or pillar segments of different cross-sectional shapes.
Figure 11:
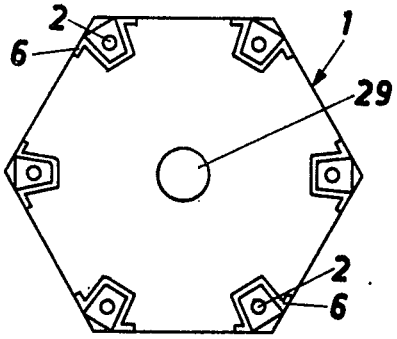

When the coupling device 3 is not to be subjected to downwardly acting impact forces, for example such as those produced by a pile drive, the casing 4, 5 may be omitted from the coupling device 3, or said device may be provided with a detachable casing. With this construction of the coupling device there is no need to produce particular coupling devices for different types of pile or pillar segments having different dimensions, since in the basic form such devices comprise only a number of connecting means 6 corresponding to the number of reinforcing rods (see FIGS. 10 and 11).

Figure 6:
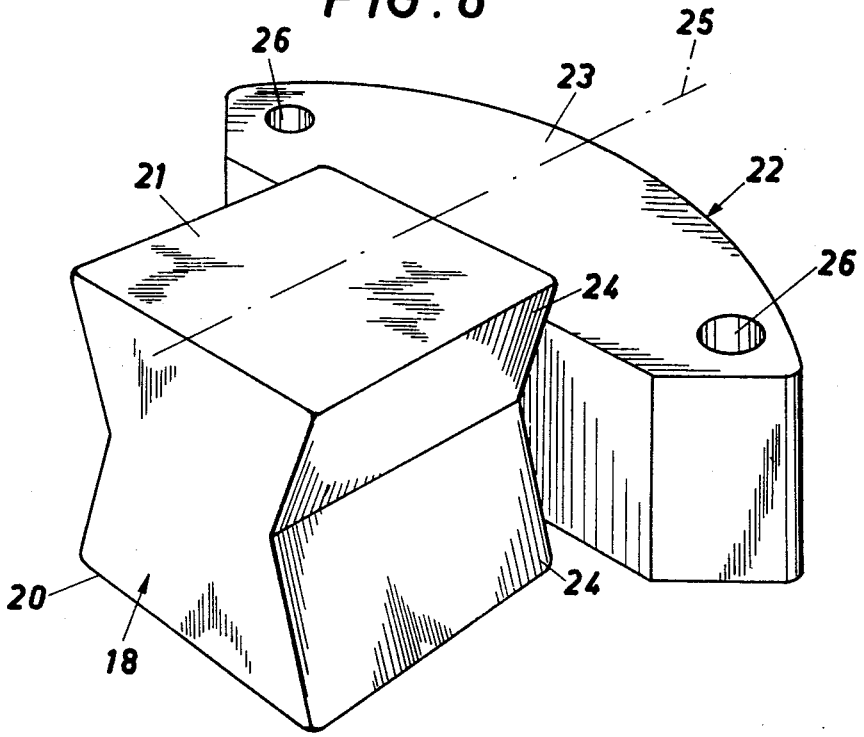
FIG. 6 shows in perspective a modified embodiment of a key for connecting together two coupling devices.
Figure 7:
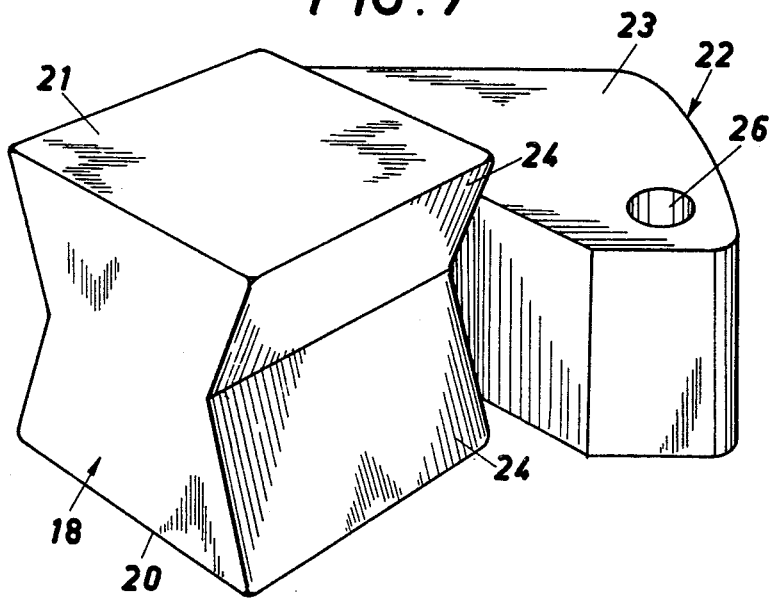
FIG. 7 is a perspective view of a further embodiment of the key.

To enable transverse beams, joist plates and the like to be connected to the pile or pillar segment, the coupling device can be supplemented with a key 18 of the form shown in FIGS. 6 and 7.

This key comprises a main body 20 which when seen in cross-section has the form of a double dove-tail and which has upper and lower planar defining side surfaces 21, (of which only the upper is shown in FIGS. 6 and 7). On one end surface of the main body 20 there is arranged an outwardly projecting shoulder 22 whose upper and lower defining sides 23 are substantially parallel with the defining sides 21 of the main body. The shoulder 23 is conveniently formed integrally with the main body and the thickness or height of the shoulder is slightly less than the thickness or height of the main body, so that end surfaces 24 are formed and so that lip 17 on the connecting means 6 can be folded into abutment with one of the end surfaces 24. The shoulder 22 of the FIG. 6 embodiment is symmetrical in relation to the longitudinal axis 25 of the key and is intended to support a load on both sides of the connecting means 6. As will be seen in FIG. 7, the shoulder 22 need not necessarily by symmetrical in relation to the main body 20, but may be so formed that it only supports load on one side of the connecting means 6. The shoulder is provided with one or more holes 26 for bolting to a frame 27 (FIG. 8) serving as a support member, a beam, plate or the like.

Figure 8:
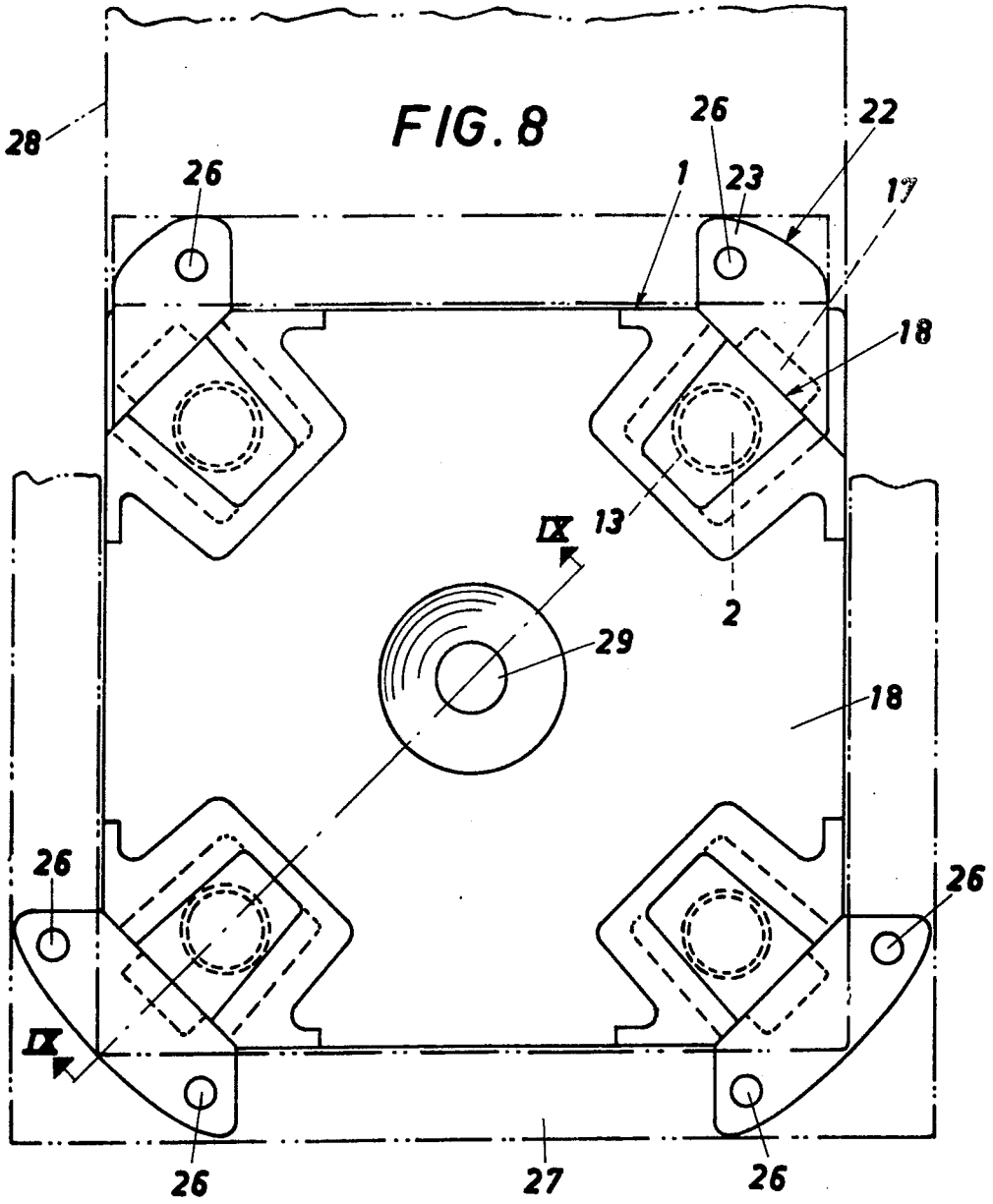
FIG. 8 is an end view of a pile segment having a coupling device.

FIG. 8 is an end view of a reinforced concrete pile segment having four connecting means 6 which are securely connected to the main reinforcing means of the pile. The FIGURE shows two alternative connection possibilities, firstly a single-sided connection of, for example, a beam 28 to the pile segment while using the keys 18 of the FIG. 7 embodiment, and secondly the connection of a joist to all sides of the pile using the keys 18 of the FIG. 6 embodiment and a load distributing frame 27.

Figure 9:
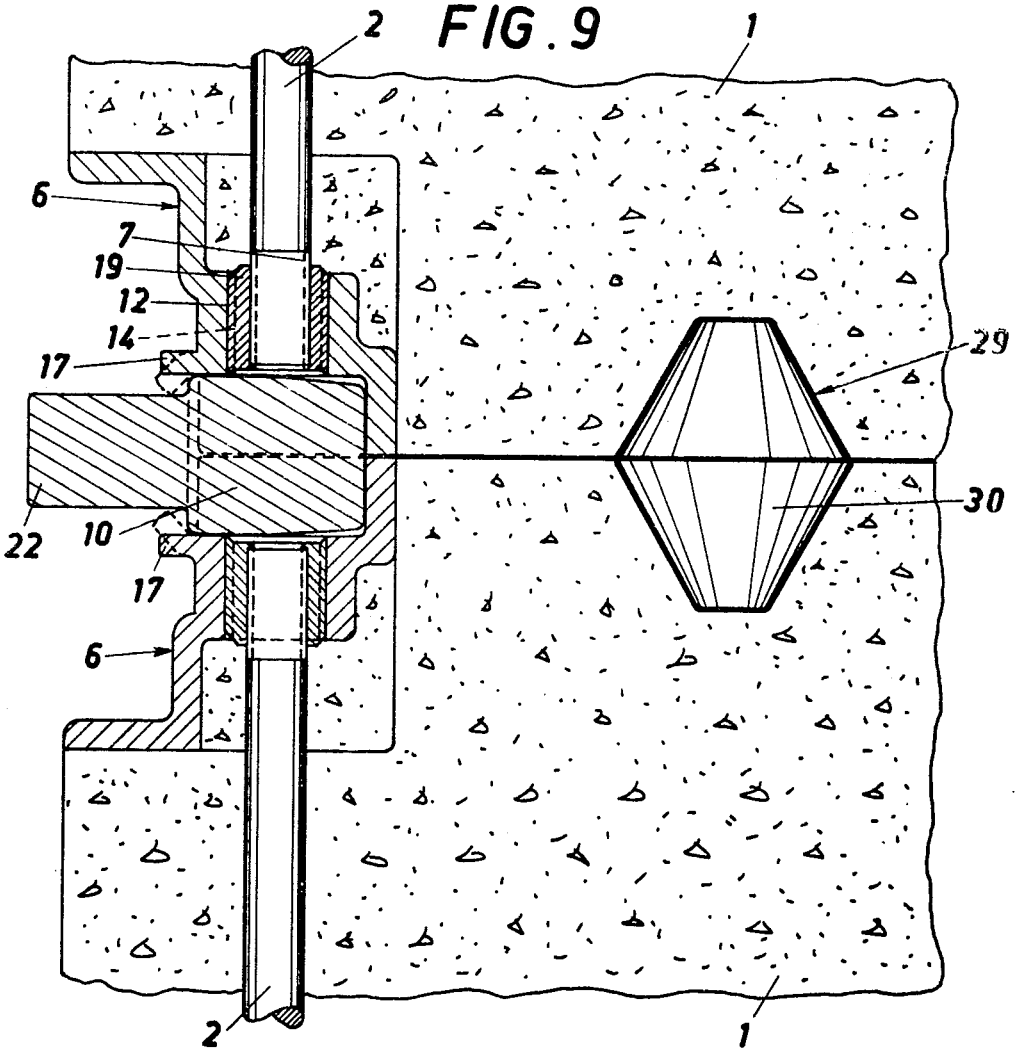
FIG. 9 is a partially sectional view along the line IX—IX in FIG. 8.

The mounting of pile segments whilst using the aforedescribed coupling devices is effected in accordance with the following (see FIG. 9). The pile segments provided with respective coupling devices are placed one upon the other and are centered by using a centering peg 30 inserted in a centering hole 29. The grooves 16 in the connecting means 6 of one pile segment are placed opposite the grooves of the connecting means 6 of another pile segment, so that the double dove-tail shaped keys 18 can be introduced into the grooves. It is not necessary for all four keys to have outwardly projecting portions, but that the construction of the separate locking means is dependent upon the intended use. Subsequent to inserting the keys, the lips 17 are folded against the associated abutment surfaces, such as the end surfaces 24 of the aforementioned main bodies, so that locking of said surfaces is obtained. The shoulder or shoulders 22 projecting outwardly from each pile segment can now be used to connect means serving as a support for transverse beams or the like.

The illustrated and disclosed embodiments are not to be considered the only possible embodiments and are not restrictive of the invention.

What I claim as my invention and desire to secure by letters patent of the United States is:

1. A coupling device for joining together reinforced concrete segments having axially protruding reinforcing rods extending therethrough comprising a plurality of pairs of separate first coupling means adapted to be secured to opposing faces of two concrete segments to be coupled together in register, each of said first coupling means being secured to the end of at least one axially protruding reinforcing rod, the number of first coupling means equaling the number of axially protruding reinforcing rods, and a plurality of second coupling means received in said first coupling means for axially and laterally coupling together said pairs of first coupling means and therewith said concrete segments.

2. The coupling device according to claim 1, wherein each first coupling means is connected to a casing forming an end wall of a respective concrete segment.

3. The coupling device according to claim 2, wherein the casing is made of a plastics material or sheet metal.

4. The coupling device according to claim 1, wherein each of said first coupling means is provided with at least one internally threaded bore adapted to receive the end of the associated reinforcing rod.

5. The coupling device according to claim 4, wherein the end of said rod is provided with a screw thread and has a smaller diameter than the diameter of said bore, and wherein a plurality of sleeve-like connecting elements are provided each of which has an external thread which corresponds to the thread of respective bores arranged in said respective first coupling means, and an internal thread which corresponds to the external thread of the respective reinforcing rod, said connecting elements being adapted to connect said first coupling means to said rods.

6. The coupling device according to claim 2, wherein each of said first coupling means is provided with a groove in which a flange formed on the bottom plate of the casing is extended to engage.

7. The coupling device according to claim 1, wherein each of said coupling means is provided with a further groove for receiving of said second coupling means, the cross-sectional shape of said further groove being the same as the cross-sectional shape of said second coupling means.

8. The coupling device according to claim 7, wherein said groove has dove-tail cross-sectional shape and said second coupling means a double dove-tail cross-sectional shape.

9. The coupling device according to claim 8, wherein at the outer end of the bottom of the further groove and/or the side walls thereof there is arranged at least one outwardly projecting lip which is intended, subsequent to being deformed, to lock the respective second coupling means inserted in the groove in said groove.

10. The coupling device according to claim 9, wherein each second coupling means of double dove-tail shaped cross-section have a greater length than the depth of its associated further groove, the portion of said second coupling means extending beyond said grove being arranged for connecting a supporting device.

11. The coupling device according to claim 10, wherein said portion comprises a portion of the second coupling means, said portion having a height extension which is narrower than the height of said second coupling means.

12. The coupling device according to claim 10, wherein said portion is provided with holes for connection to the supporting device.

* * * * *